US011143004B2

(12) United States Patent
Koli et al.

(10) Patent No.: US 11,143,004 B2
(45) Date of Patent: Oct. 12, 2021

(54) FLOW CHARACTERISTIC CONTROL USING TUBE INFLOW CONTROL DEVICE

(71) Applicants: Jai Kishan Koli, Houston, TX (US); Britain A. Fisher, Houston, TX (US); Aaron C. Hammer, Houston, TX (US)

(72) Inventors: Jai Kishan Koli, Houston, TX (US); Britain A. Fisher, Houston, TX (US); Aaron C. Hammer, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 421 days.

(21) Appl. No.: 15/680,456

(22) Filed: Aug. 18, 2017

(65) Prior Publication Data

US 2019/0055823 A1 Feb. 21, 2019

(51) Int. Cl.
*E21B 43/08* (2006.01)
*E21B 43/12* (2006.01)

(52) U.S. Cl.
CPC ..... *E21B 43/08* (2013.01); *E21B 43/12* (2013.01)

(58) Field of Classification Search
CPC ..... E21B 43/08
See application file for complete search history.

(56) References Cited

U.S. PATENT DOCUMENTS 5,435,393 A 7/1995 Brekke et al.
6,112,817 A * 9/2000 Voll ..... E21B 34/08 166/370
7,469,743 B2 * 12/2008 Richards ..... E21B 43/08 166/227
2006/0113089 A1 6/2006 Henriksen et al.
2007/0246210 A1 10/2007 Richards
2008/0041588 A1 * 2/2008 Richards ..... E21B 34/08 166/265
2009/0095468 A1 4/2009 Augustine et al.
2015/0021015 A1 1/2015 Xiao
2015/0292300 A1 * 10/2015 Franklin ..... E21B 43/08 166/244.1
2015/0300123 A1 * 10/2015 Kang ..... E21B 43/12 166/302
2015/0337622 A1 11/2015 Lopez et al.

OTHER PUBLICATIONS

"Increasing oil production worldwide", pp. 1-3, retrieved Aug. 10, 2017, retrieved from the internet www.inflowcontrol.no.
Zeng et al., "Comparative Study on Passive Inflow Control Devices by Numerical Simulation", SL, 2013, vol. 9, No. 3, pp. 169-180.
International Search Report and Written Opinion for PCT Application No. PCT/US2018/042284, dated Oct. 23, 2018, pp. 1-10.

* cited by examiner

*Primary Examiner* — D. Andrews
(74) *Attorney, Agent, or Firm* — Cantor Colburn LLP

(57) ABSTRACT

A method and system perform flow characteristic control. The system includes a tube inflow control device (ICD) including a tube input port. The tube ICD conveys fluid along an axial length of a tube of the tube ICD. The axial length of the tube controls a drop in pressure of the fluid between the tube input port and a corresponding tube output port. The system also includes a base pipe with an input port coupled to the tube output port of the tube of the tube ICD, wherein the base pipe is configured to convey the fluid to a surface.

14 Claims, 7 Drawing Sheets

FLOW CHARACTERISTIC CONTROL USING TUBE INFLOW CONTROL DEVICE

BACKGROUND

In the drilling and completion industry, the formation of boreholes and production tubing can affect the productive life of a well. Generally, a long horizontal well terminates at what is referred to as a toe section and transitions between the horizontal well and a vertical well that reaches the surface. The area where the well transitions is referred to as a heel section. By the production stage, the well may typically include a production pipe surrounded by a screen over all or portions of its length. If the drawdown pressure at the heel section is higher than at the toe section, the imbalanced production profile may cause water to be drawn to the heel over time, thereby ending the productive life of the well. To equalize the pressure drop along the well length, passive inflow control devices (ICDs) may be used. ICDs are placed in each screen joint. That is, ICDs are used between the screen, where formation fluid enters, and the ports through which the formation fluid enters the production pipe. One type of ICD is a helical channel that uses a friction mechanism to achieve a uniform inflow profile. Specifically, helical channels on an outer surface of the base pipe are used to control pressure of formation fluid that flows in the annulus between the screen and production tube and enters the base pipe through ports in the base pipe. However, helical channel ICDs are made of two machined parts, a restrictor (the machined helical channels) and a housing (a concentric cover that forces flow over the helical channels), that are fit together. Because the helical channel is etched into the base pipe, the channel cannot be modified.)

Thus, the art would benefit from flow characteristic control using a tube ICD.

SUMMARY

A system includes a tube inflow control device (ICD) including a tube input port and configured to convey fluid along an axial length of a tube of the tube ICD. The axial length of the tube controls a drop in pressure of the fluid between the tube input port and a corresponding tube output port. The system also includes a base pipe with an input port coupled to the tube output port of the tube of the tube ICD. The base pipe is configured to convey the fluid to a surface.

A method of assembling tubing includes arranging a tube inflow control device (ICD) with a tube input port of a tube of the tube ICD and configuring the tube ICD to convey fluid along an axial length of a tube of the tube ICD. The axial length of the tube controls a drop in pressure of the fluid between the tube input port and a corresponding tube output port. The method also includes coupling an input port of a base pipe to the tube output port of the tube of the tube ICD and configuring the base pipe to convey the fluid to a surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

As previously noted, current helical channel ICDs are fabricated through a tune consuming process and the flow characteristic defined by the helical channels cannot easily be modified once formed. Embodiments of the systems and methods detailed herein relate to flow characteristic control using tube ICDs. A tube is generally a hollow cylinder that can facilitate fluid flow. According to embodiments, in the case of the tube ICD, the tube shape over its axial length as well as the tube cross-sectional shape over its axial length or at particular portions may be controlled. A tube ICD rather than helical channels form the interface between a screen, through Which formation fluid enters the production well, and a base pipe. Based on modifications to the length and cross-sectional features of the tube ICD, flow characteristics of inflow into the base pipe may be controlled. While downhole production tubing and production tubing using a screen are specifically discussed for explanatory purposes, embodiments of the tube ICD detailed herein may be used to control pressure of inflow into any pipe that convey fluid and may or may not be used with a screen.

Figure 1:
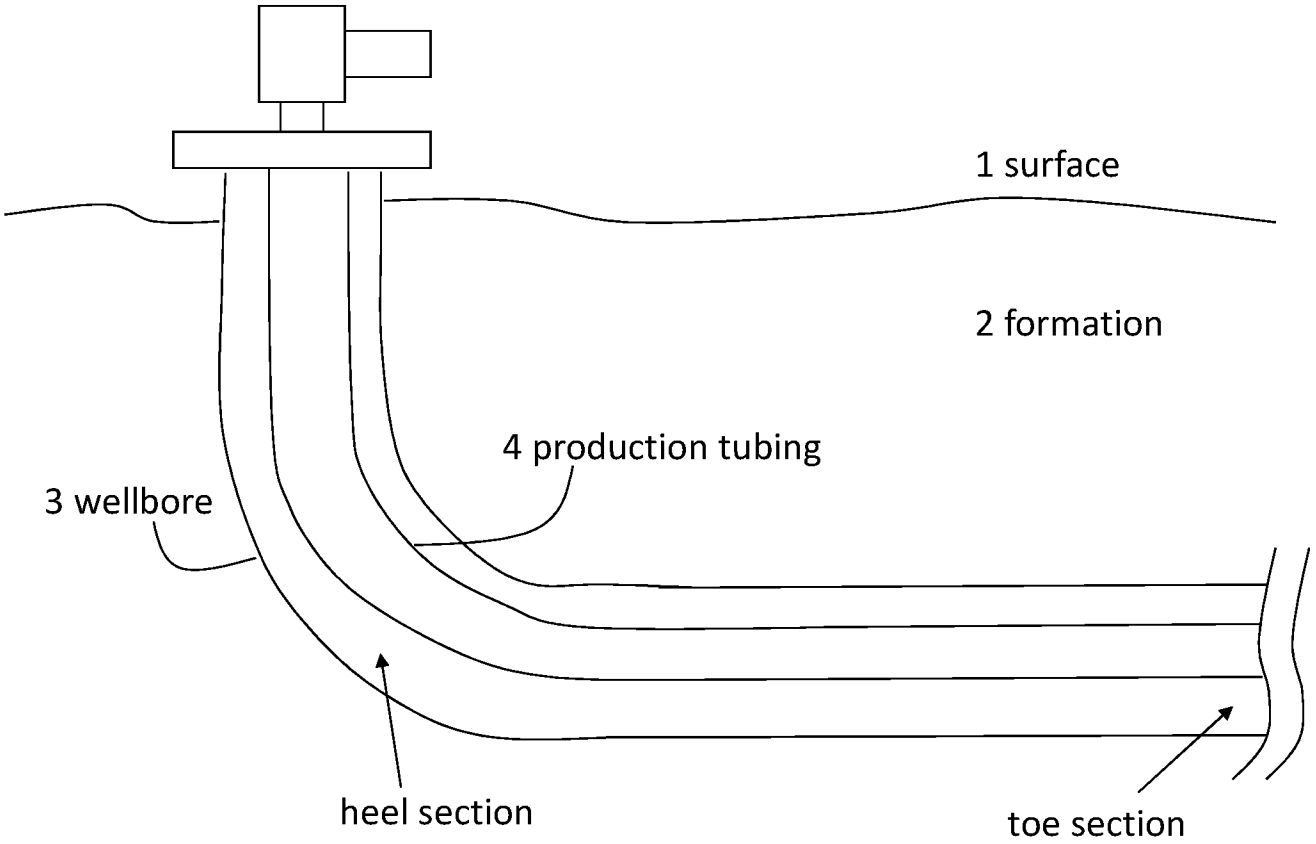
FIG. 1 depicts a cross-sectional view of a production well according to embodiments.

Referring to FIG. 1, a cross-sectional view of a production well according to embodiments is shown. The wellbore 3 formed in the formation 2 below the surface 1 transitions between horizontal and vertical orientations at the heel section. The horizontal portion terminates in the toe section. Relevant portions of the production tubing 4 within the wellbore 3 are detailed in FIG. 2.

Figure 2:
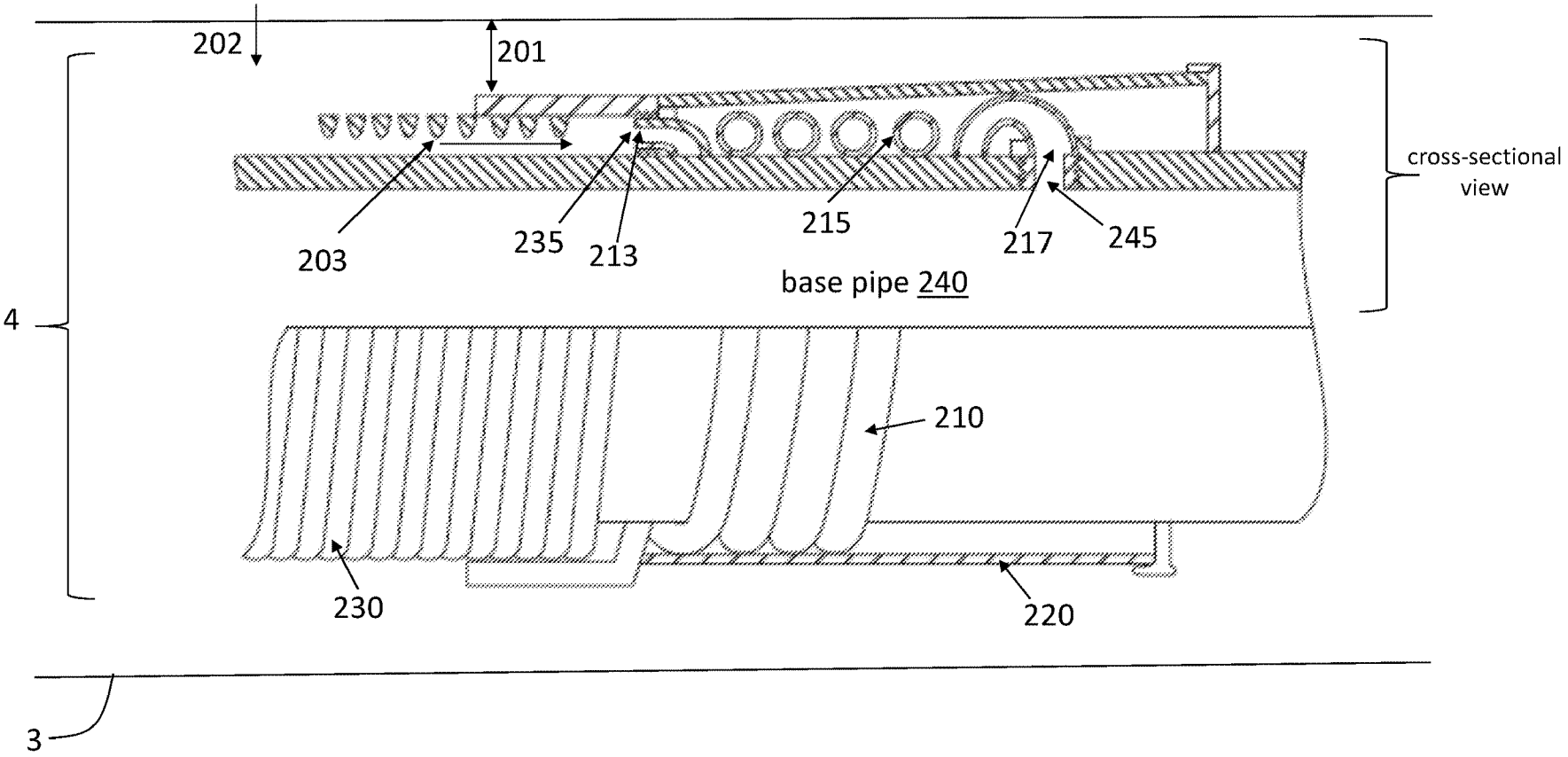
FIG. 2 details interconnections with a tube inflow control device (ICD) according to embodiments.

FIG. 2 details interconnections with a tube ICD 210 according to one or more embodiments. An annulus 201 is formed between the wall of the wellbore 3 and the production tubing 4. The production tubing 4 includes a base pipe 240 that brings formation fluid 202 to the surface 1. The formation fluid 202 enters from the annulus 201 via the screen 230. The screen 230 may be positioned in specific portions of the production tubing 4 or over its entire length.

The tube ICD 210 is disposed between each screen 230 and corresponding set of ports 245 that facilitate inflow into the base pipe 240. Different types of screens 230 are known and are not detailed here. Generally a screen 230 functions to allow formation fluid 202 in from the annulus 201 while filtering out sand and other undesired material. Thus, the flow within the screen 230 may be considered filtered formation fluid 203, as indicated in FIG. 2. Screen output ports 235 ultimately facilitate the flow of the filtered formation fluid 203 into the base pipe 240 through ports 245. Previously, a helical channel may have been fabricated on the outer surface of the base pipe 240 between the screen output ports 235 and ports 245 of the base pipe 240 to control flow into the base pipe 240. A sleeve or housing over the helical channel would have ensured that the pressure of flow within the annulus created by the helical channel and the sleeve was affected by the helical channel.

According to embodiments detailed herein, formation fluid exiting the screen output ports 235 enters corresponding tubes of the tube ICD 210 via tube input ports 213 rather than flowing within an annulus. Each tube of the tube ICD 210 terminates through a tube output port 217 to a port 245 of the base pipe 240. In the embodiment shown in FIG. 2, the tube ICD 210 includes only one tube and, thus, includes only one tube input port 213 and one tube output port 217. As further detailed with reference to FIGS. 3-7, the length and cross-sectional shape of each tube of the tube ICD 210 is used to control the pressure drop between the screen 230 and port 245 of the base pipe 240. As indicated, the top portion is a cross-sectional view while the portion below the base pipe 240 only has a cut-away view of the protective cover 220 of the tube ICD 210. The optional protective cover 220 may have the same diameter as the adjacent screen 230, for example. The cross-sectional view shows the cross-sectional shape 215 of the tube ICD 210. The exemplary cross-sectional shape 215 is circular.

Figure 3:
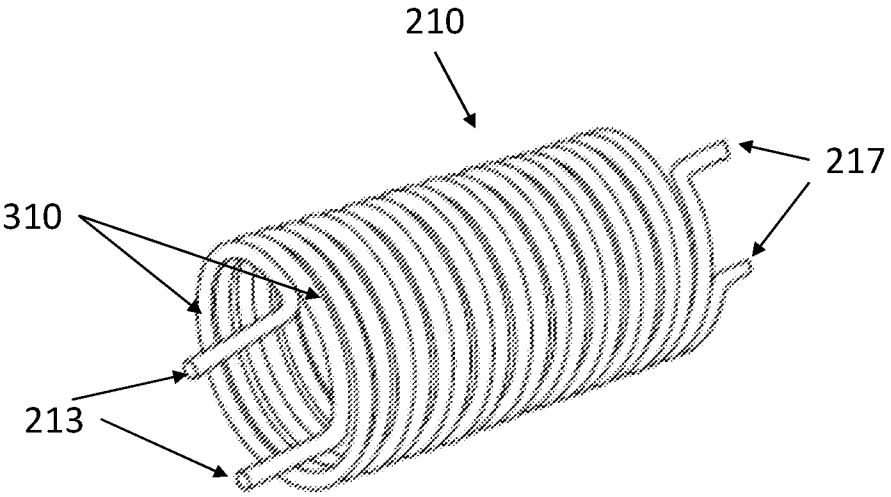
FIG. 3 is a three-dimensional view of an exemplary embodiment of a tube ICD; Also include a claim for rectangular, triangular.

FIG. 3 is a three-dimensional view of an exemplary embodiment of a tube ICD 210. The exemplary tube ICD 210 shown in FIG. 3 includes two tube input ports 213 and two tube output ports 217 corresponding with two tubes 310. That is, the tube ICD 210 interweaves two tubes 310, each with its own input port 213 and tube output port 217. In alternate embodiments, additional tubes may be part of the tube ICD 210.

Figure 4:
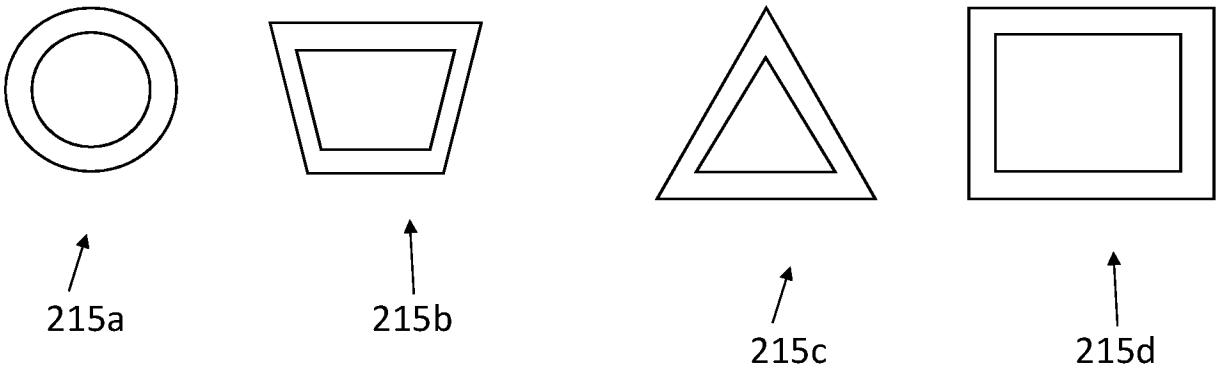
FIG. 4 depicts four exemplary cross-sectional shapes for the tube ICD according to different embodiments.

FIG. 4 depicts four exemplary cross-sectional shapes 215*a*, 215*b*, 215*c*, 215*d* (generally referred to as 215) for the tube ICD 210 according to different embodiments. The cross-sectional shape 215*a* is circular. The cross-sectional shape 215*b* is trapezoidal. The cross-sectional shape 215*c* is triangular. The cross-sectional shape 215*d* is rectangular. When different tube ICDs 210 are included in different parts of the production tubing 4, the different tube ICDs 210 may have different cross-sectional shapes 215. When multiple tubes make up a tube ICD 210, as in the exemplary embodiment show in FIG. 3, each tube can have a different cross-sectional shape or different cross-sectional features along the length of the tube. While the length affects pressure drop in the tube ICD 210 more than cross-sectional shape 215, changes in the cross-sectional shape 215 along the length of the tube ICD 210 may affect pressure drop, as discussed with reference to FIGS. 5 and 6.

Figure 6:
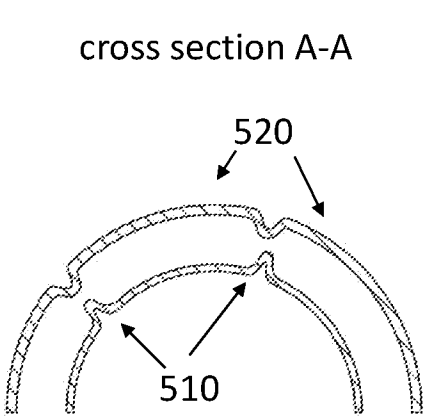
FIG. 6 is a cross-sectional view along an axial length of the tube ICD according to the embodiment depicted in FIG. 5.
Figure 5:
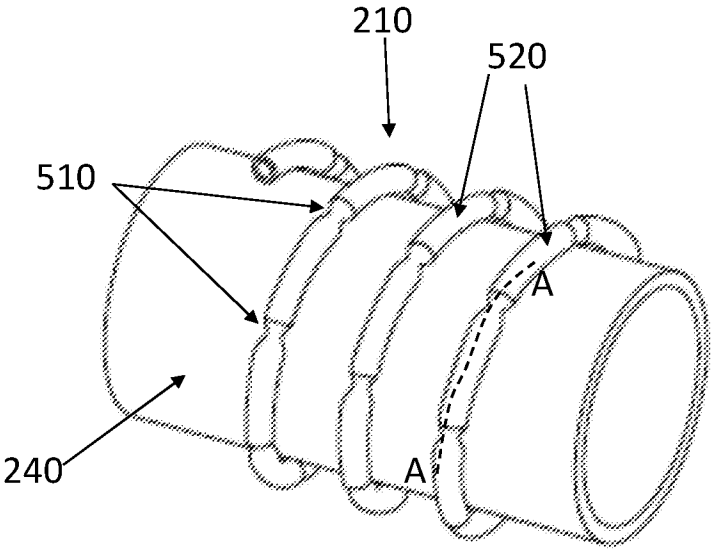
FIG. 5 depicts a portion of a base pipe with a tube ICD according to an exemplary embodiment wrapped around its outer surface.

FIG. 5 depicts a portion of a base pipe 240 with a tube ICD 210 according to an exemplary embodiment wrapped around its outer surface. As FIG. 5 shows, the tube ICD 210 may include crimped sections 510 that separate un-crimped sections 520. A cross-sectional view A-A along the axial length of the tube ICD 210 is shown in FIG. 6. As FIG. 6 indicates, the crimped sections 510 represent a constriction in the flow facilitated by the un-crimped sections 520. This constriction results in an orifice restriction in addition to the friction drop restriction provided by the tube ICD 210. Thus, the crimped sections 510 may increase pressure drop along the tube ICD 210 as compared with a tube ICD 210 that does not include the crimped sections 510.

Figure 7:
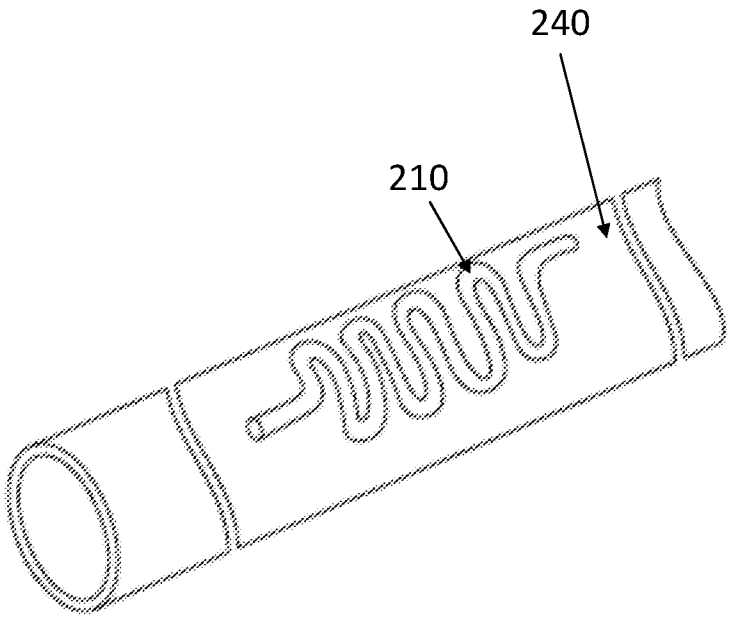
FIG. 7 shows an exemplary embodiment of a tube ICD that is not wrapped entirely around the outer surface of the base pipe.
Figure 8:
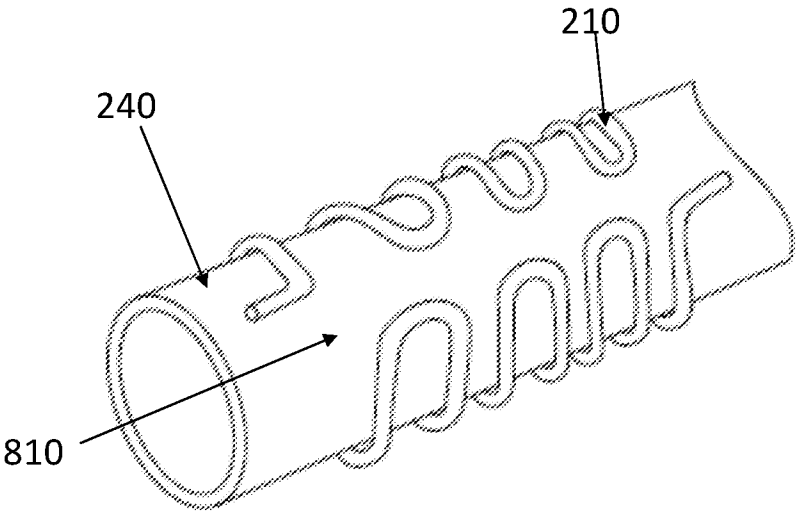
FIG. 8 shows exemplary embodiment of a tube ICD that is wrapped around the base pipe.

While crimped sections 510 in the tube ICD 210 affect pressure drop, the particular way that a given length of the tube ICD 210 with a given cross-sectional shape 215 is wrapped around the base pipe 240 does not affect the pressure drop. FIG. 7 shows an exemplary embodiment of a tube ICD 210 that is not wrapped entirely around the outer surface of the base pipe 240 but is instead arranged on one side of the base pipe. FIG. 8 shows an exemplary embodiment of a tube ICD 210 that is wrapped around the base pipe 240 in such a way that an axial portion 810 of the outer surface of the base pipe 240 is not crossed by the tube ICD 210. This facilitates the routing of control lines (e.g., optical fiber) in a way that does not interfere with the tube ICD 210. The examples shown in FIGS. 7 and 8 are only illustrative of the flexibility in placement according to various embodiments rather than limiting the arrangement of the tube ICD 210.

Set forth below are some embodiments of the foregoing disclosure:

Embodiment 1: A system includes a tube inflow control device (ICD) including a tube input port. The tube ICD conveys fluid along an axial length of a tube of the tube ICD. The axial length of the tube controls a drop in pressure of the fluid between the tube input port and a corresponding tube output port. The system also includes a base pipe with an input port coupled to the tube output port of the tube of the tube ICD. The base pipe conveys the fluid to a surface.

Embodiment 2: The system according to any prior embodiment, wherein the system also includes a screen to filter formation fluid entering the screen from an annulus formed by the screen and a wellbore wall such that the fluid enters the screen. The tube input port is coupled to a screen output port of the screen.

Embodiment 3: The system according to any prior embodiment, wherein the tube ICD includes two or more of the tubes, each of the two or more tubes including a corresponding one of the tube input ports and a corresponding one of the tube output ports.

Embodiment 4: The system according to any prior embodiment, wherein a cross-sectional shape of the tube of the tube ICD is circular, trapezoidal, triangular, or rectangular.

Embodiment 5: The system according to any prior embodiment, wherein a cross-sectional shape of the tube of the tube ICD is not uniform over the axial length of the tube.

Embodiment 6: The system according to any prior embodiment, wherein the cross-sectional shape of the tube in a first portion differs from the cross-sectional shape of the tube in a second portion, the first portion and the second portion being at different positions along the axial length of the tube of the ICD.

Embodiment 7: The system according to any prior embodiment, wherein a cross-sectional area at the first portion is less than a cross-sectional area at the second portion.

Embodiment 8: The system according to any prior embodiment, wherein the tube of the tube ICD is shaped as a coil wrapped around an outer surface of the base pipe.

Embodiment 9: The system according to any prior embodiment, wherein the tube of the tube ICD is formed as a serpentine shape and disposed on the base pipe.

Embodiment 10: The system according to any prior embodiment, wherein the tube of the tube ICD is shaped and arranged around the base pipe to leave an axial length of the base pipe uncovered by any portion of the tube.

Embodiment 11: A method of assembling tubing includes arranging a tube inflow control device (ICD) with a tube input port of a tube of the tube ICD and configuring the tube ICD to convey fluid along an axial length of a tube of the tube ICD. The axial length of the tube controls a drop in pressure of the fluid between the tube input port and a corresponding tube output port. The method also includes coupling an input port of a base pipe to the tube output port of the tube of the tube ICD and configuring the base pipe to convey the fluid to a surface.

Embodiment 12: The method according to any prior embodiment, wherein the method also includes positioning a screen to form an annulus with a wellbore wall and configuring the screen to filter formation fluid entering the screen from the annulus such that the fluid enters the screen, and coupling the tube input port of the tube of the tube ICD to a screen output port of the screen.

Embodiment 13: The method according to any prior embodiment, wherein the method also includes interweaving two or more of the tubes to form the tube ICD, wherein each of the two or more tubes including a corresponding one of the tube input ports and a corresponding one of the tube output ports.

Embodiment 14: The method according to any prior embodiment, wherein the method also includes fabricating the tube of the tube ICD with a circular cross-sectional shape, a trapezoidal cross-sectional shape, a triangular cross-sectional shape, or a rectangular cross-sectional shape.

Embodiment 15: The method according to any prior embodiment, wherein the method also includes fabricating the tube of the tube ICD with a non-uniform cross-sectional shape over the axial length of the tube.

Embodiment 16: The method according to any prior embodiment, wherein the method also includes fabricating the tube of the tube ICD with the cross-sectional shape in a first portion being different than the cross-sectional shape in a second portion, the first portion and the second portion being at different positions along the axial length of the tube of the ICD.

Embodiment 17: The method according to any prior embodiment, wherein the fabricating the tube of the tube ICD includes a cross-sectional area at the first portion is less than a cross-sectional area at the second portion.

Embodiment 18: The method according to any prior embodiment, the method also includes shaping the tube of the tube ICD as a coil wrapped around an outer surface of the base pipe.

Embodiment 19: The method according to any prior embodiment, the method also includes forming the tube of the tube ICD as a serpentine shape and disposing the tube of the tube ICD on the base pipe.

Embodiment 20: The method according to any prior embodiment, the method also includes shaping the tube of the tube ICD and arranging the tube of the tube ICD around the base pipe to leave an axial length of the base pipe uncovered by any portion of the tube.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation 202, the fluids resident in a formation 202, a wellbore 3, and/or equipment in the wellbore 3, such as production tubing 4. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, polymer injection, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system, comprising:

a tube inflow control device (ICD) including a tube input port and configured to convey fluid along an axial length of a tube of the tube ICD, wherein the axial length of the tube controls a drop in pressure of the fluid between the tube input port and a corresponding tube output port; and a base pipe with an input port coupled to the tube output port of the tube of the tube ICD, wherein the base pipe is configured to convey the fluid to a surface, wherein a cross-section of the tube of the tube ICD is not uniform over the axial length of the tube, the cross-section of the tube at the tube input port is an input cross-section, the cross-section of the tube at the tube output port is an output cross-section, the cross-section of the tube transitions along the axial length from a first cross-section that is different from the input cross-section and the output cross-section to a second cross-section to a third cross-section that is different from the input cross-section and the output cross-section, a length of the tube of the tube ICD having the second cross-section is longer than a length of the tube of the tube ICD having the first cross-section and the third cross-section, and a volume available to convey the fluid is different based on the first cross-section and the second cross-section.

2. The system according to claim 1, further comprising a screen configured to filter formation fluid entering the screen from an annulus formed by the screen and a wellbore wall such that the fluid enters the screen, wherein the tube input port is coupled to a screen output port of the screen.

3. The system according to claim 1, wherein the tube ICD includes two or more of the tubes, each of the two or more tubes including a corresponding one of the tube input ports and a corresponding one of the tube output ports.

4. The system according to claim 1, wherein a cross-sectional shape of the tube of the tube ICD is circular, trapezoidal, triangular, or rectangular.

5. The system according to claim 1, wherein the tube of the tube ICD is shaped as a coil wrapped around an outer surface of the base pipe.

6. The system according to claim 1, wherein the tube of the tube ICD is formed as a serpentine shape and disposed on the base pipe.

7. The system according to claim 1, wherein the tube of the tube ICD is shaped and arranged around the base pipe to leave an axial length of the base pipe uncovered by any portion of the tube.

8. A method of assembling tubing, the method comprising:

fabricating a tube of a tube inflow control device (ICD) with a non-uniform cross-section over an axial length of the tube;

arranging the tube ICD with a tube input port of the tube of the tube ICD and configuring the tube ICD to convey fluid along the axial length of the tube of the tube ICD, wherein the axial length of the tube controls a drop in pressure of the fluid between the tube input port and a corresponding tube output port, the cross-section of the tube at the tube input port is an input cross-section, the cross-section of the tube at the tube output port is an output cross-section, the cross-section of the tube transitions along the axial length from a first cross-section that is different from the input cross-section and the output cross-section to a second cross-section to a third cross-section that is different from the input cross-section and the output cross-section, a length of the tube of the tube ICD having the second cross-section is longer than a length of the tube of the tube ICD having the first cross-section and the third cross-section, and a volume available to convey the fluid is different based on the first cross-section and the second cross-section; and coupling an input port of a base pipe to the tube output port of the tube of the tube ICD and configuring the base pipe to convey the fluid to a surface.

9. The method according to claim 8, further comprising positioning a screen to form an annulus with a wellbore wall and configuring the screen to filter formation fluid entering the screen from the annulus such that the fluid enters the screen, and coupling the tube input port of the tube of the tube ICD to a screen output port of the screen.

10. The method according to claim 8, further comprising interweaving two or more of the tubes to form the tube ICD, wherein each of the two or more tubes including a corresponding one of the tube input ports and a corresponding one of the tube output ports.

11. The method according to claim 8, further comprising fabricating the tube of the tube ICD with a circular cross-sectional shape, a trapezoidal cross-sectional shape, a triangular cross-sectional shape, or a rectangular cross-sectional shape.

12. The method according to claim 8, further comprising shaping the tube of the tube ICD as a coil wrapped around an outer surface of the base pipe.

13. The method according to claim 8, further comprising forming the tube of the tube ICD as a serpentine shape and disposing the tube of the tube ICD on the base pipe.

14. The method according to claim 8, further comprising shaping the tube of the tube ICD and arranging the tube of the tube ICD around the base pipe to leave an axial length of the base pipe uncovered by any portion of the tube.

* * * * *